US007416356B2

(12) United States Patent
Quilantan

(10) Patent No.: US 7,416,356 B2
(45) Date of Patent: Aug. 26, 2008

(54) NOTE-PAD HOLDER WITH INCORPORATED PAGE MARK/COVER STRAP AND WRITING UTENSIL HOLDER

(75) Inventor: Mark Anthony Quilantan, 14533 S. Kilbourn Ave., Midlothian, IL (US) 60445

(73) Assignee: Mark Anthony Quilantan, Midlothian, IL (US)

( * ) Notice: Subject to any disclaimer, the term of this patent is extended or adjusted under 35 U.S.C. 154(b) by 548 days.

(21) Appl. No.: 11/093,459

(22) Filed: Mar. 29, 2005

(65) Prior Publication Data

US 2007/0280774 A1 Dec. 6, 2007

(51) Int. Cl.
*B43K 23/02* (2006.01)
*B43K 29/00* (2006.01)
*B42D 9/00* (2006.01)

(52) U.S. Cl. ..... 401/131; 401/195; 116/234; 116/237; 116/239

(58) Field of Classification Search ..... 401/48, 401/88, 131, 195, 237; 116/234, 235, 239; 281/42, 48
See application file for complete search history.

(56) References Cited

U.S. PATENT DOCUMENTS 2,541,735 A * 2/1951 Albrecht, Jr. ..... 281/42
6,481,367 B2 * 11/2002 McClosky ..... 116/235
6,641,172 B1 * 11/2003 Olson ..... 281/42
2002/0139291 A1 * 10/2002 Roundy ..... 116/234

* cited by examiner

*Primary Examiner*—David Walczak
*Assistant Examiner*—Michael Barca

(57) ABSTRACT

A note-pad holder with incorporated page mark includes an adjustable Velcro attachment support member for attachment to a hardback book with a compartment for accessories and holding device for a writing utensil.

1 Claim, 4 Drawing Sheets

NOTE-PAD HOLDER WITH INCORPORATED PAGE MARK/COVER STRAP AND WRITING UTENSIL HOLDER

CROSS-REFERENCE TO RELATED APPLICATION

60/537,296

STATEMENT REGARDING FEDERALLY SPONSORED RESEARCH OR DEVELOPMENT

Not applicable

REFERENCE TO SEQUENCE LISTING

Not applicable

FIELD OF THE INVENTION

This invention relates generally to the field of writing instruments and more particularly to a notepad holder with an integrated bookmark.

BACKGROUND OF THE INVENTION

Many people find that the need for a pen and writing paper can arise frequently as they go about their daily routines particularly when reading. Women can store pens and writing paper in their handbags, but since men do not typically carry handbags, they may find carrying writing materials to sometimes be problematic. Similarly, there are times when a person desires to carry only the minimal or optimal accompaniments along with their reading material. Of course, it can happen that one has either a pen, or paper, but not both in their possession at the time it is required.

A review of the prior art describes several implement holders, but none provide the advantages of the present invention. Many of the prior art devices accommodate only a single pencil or pen. In U.S. Pat. No. 5,072,686 (1991), Falco describes a combination bookmark and pen holder which retains a range of different diameter pens. However, the device does not incorporate means for attachment to a surface, and retains only a single pen. In U.S. Pat. No. 3,564,668 (1971), Kirk describes an apparatus which holds a plurality of pens or pencils within a series of parallel semi-tubular clips. However, the adjacent clips are supported on the outer surface of the book cover and would therefore interfere with carrying the book or with stacking of the book against other books or surfaces. In addition, the clips are susceptible to being bent or broken.

None of the above inventions and patents taken either singly or in combination is seen to describe the instant invention as claimed. Accordingly, it is among the objects of the present invention to provide a novel article and bookmark device which is compact, simple to manufacturer, and economical in cost. Another objective of the present invention is to provide a holder which may be releasibly attached to the cover of a book or other surface. Still another objective is to provide a holder for accommodating a plurality of articles of varied dimensions.

SUMMARY OF THE INVENTION

One object of the present invention is to provide a note pad holder assembly, or a book, which provides substantial page placement, but which does not require a swinging wire (or equivalent) frame It is an objective of the invention to provide a note-pad holder with incorporated page mark which is relatively small in size and convenient to carry.

It is another objective to provide a note-pad holder with incorporated page mark which is a unitary piece, without removable elements which can become lost.

It is a further object of the invention to provide a combination writing instrument and note-pad holder with incorporated page mark which is designed to be ergonomically easy to use.

It is yet a further object of the invention to provide a note-pad holder with incorporated page mark that allows full adjustability of the page mark to correspond to varying depths of pages to be marked while enabling the note-pad holder to remain secured to the book cover It is yet a further object of the invention to provide a note-pad holder with incorporated page mark with an integrated writing instrument which is inexpensive and easy to manufacture.

In accordance with the above objectives, a note-pad holder with incorporated page-mark device is provided which comprises a generally rectangular base section hingedly connected to a lid. The base has an instrument chamber attached, where a writing instrument can be stored. The device includes a means to store a note-pad between the lid and base within the instrument whereby said writing instrument is available for a user to write messages on the note-pad.

The writing instrument can be a ball point pen, a felt pen, a mechanical pencil, or any other conventional writing implement.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and. scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a note-pad holder with incorporated page mark apparatus and method which has many of the advantages of the closures mentioned heretofore and many novel features that result in a note-pad holder with incorporated page mark which is not anticipated, rendered obvious, suggested, or even implied by any of the prior art tool guides, either alone or in any combination thereof.

It is another object of the present invention to provide a note-pad holder with incorporated page mark which may be easily and efficiently manufactured and marketed.

It is a further object of the present invention to provide a note-pad holder with incorporated page mark device which is of a durable and reliable construction.

An even further object of the present invention is to provide a note-pad holder with incorporated page mark which is susceptible of a low cost of manufacture with regard to both materials and labor, and which accordingly is then susceptible of low prices of sale to the consuming public, thereby making such planting device economically available to the buying public.

Still yet another object of the present invention is to provide a note-pad holder with incorporated page mark which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION OF THE PREFERRED EMBODIMENTS

Figure 1:
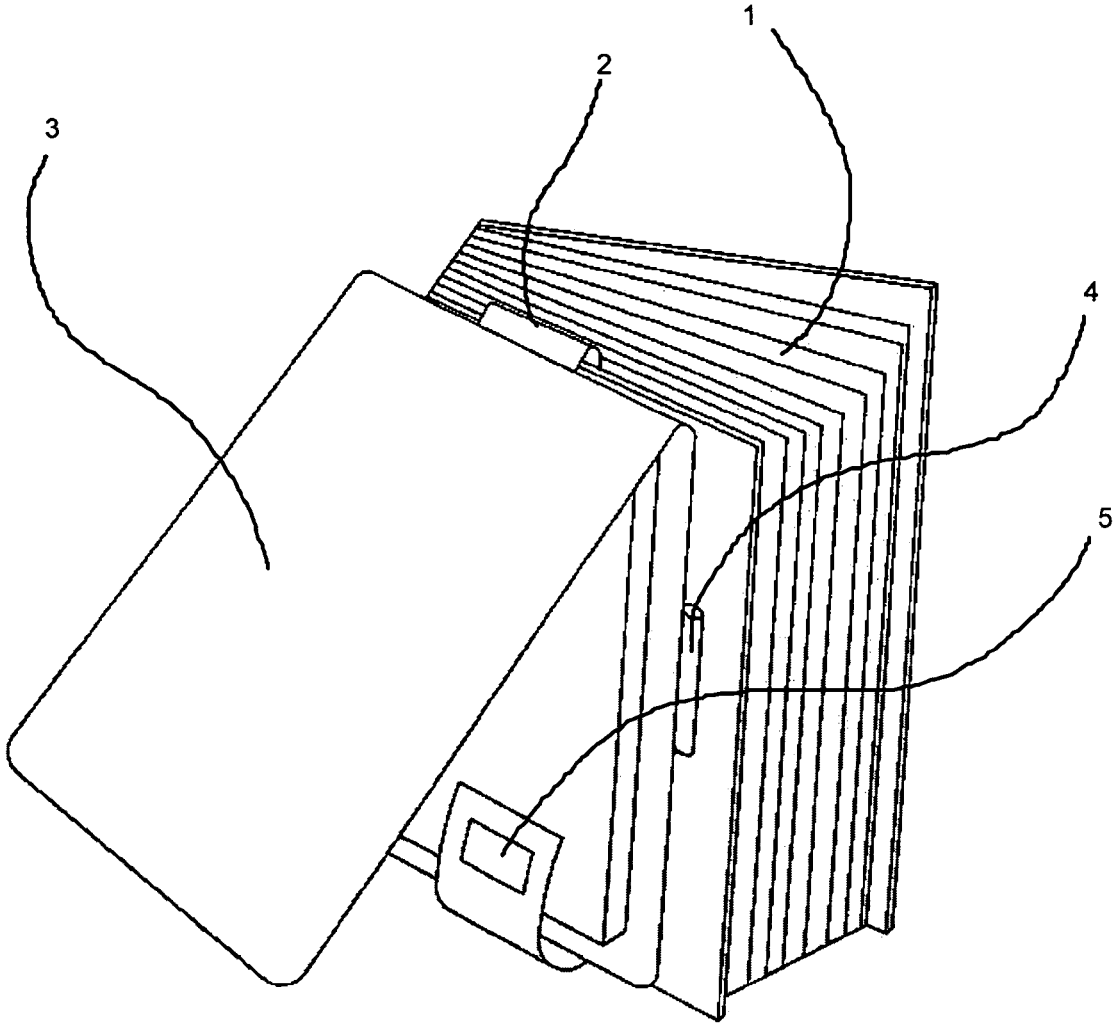
FIG. 1 is an elevational open front view of the present note-pad holder with incorporated page mark affixed to a hardback book.
Figure 2:
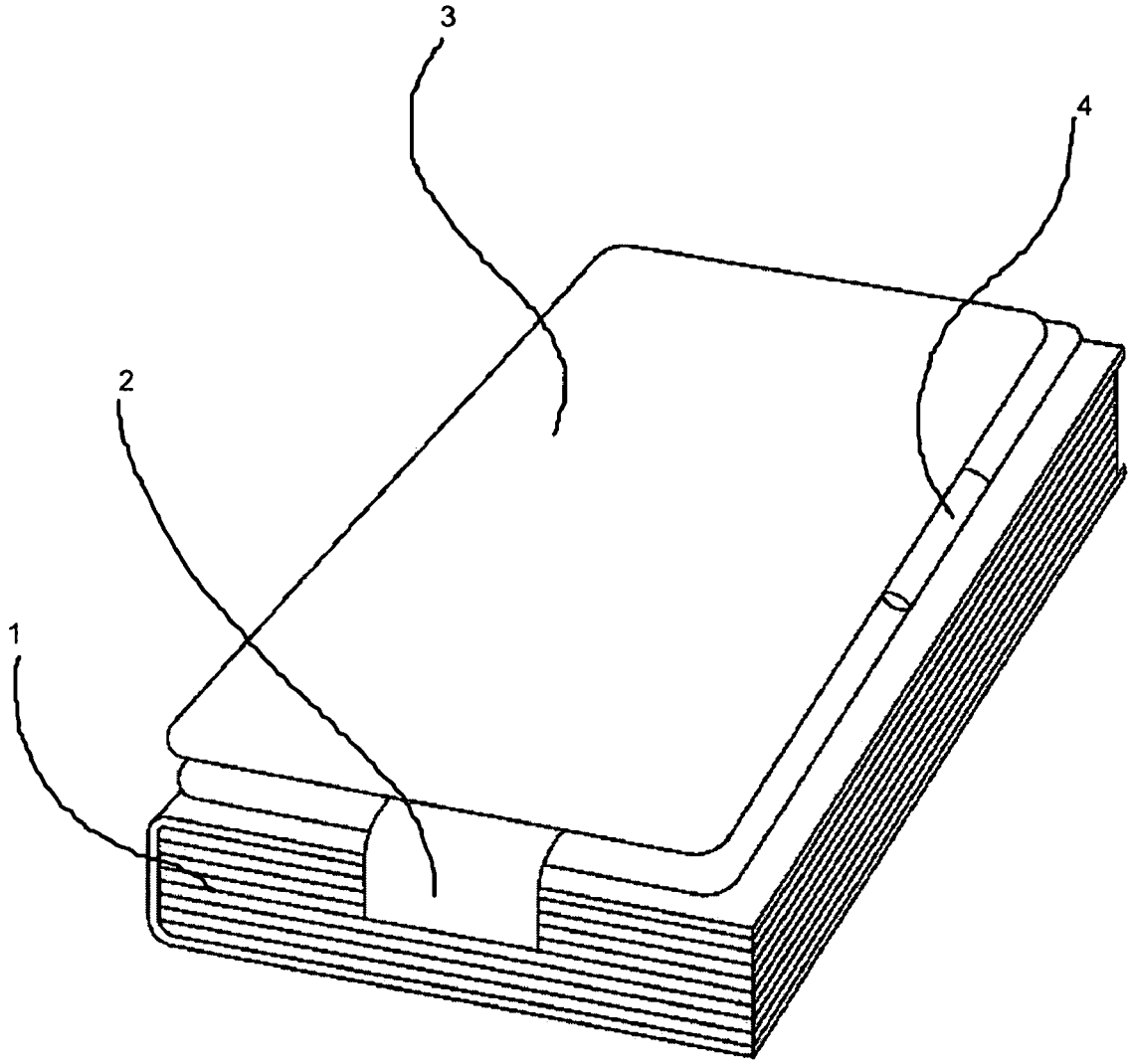
FIG. 2 is an elevational closed front view of the present note-pad holder with incorporated page mark affixed to a hardback book.
Figure 3:
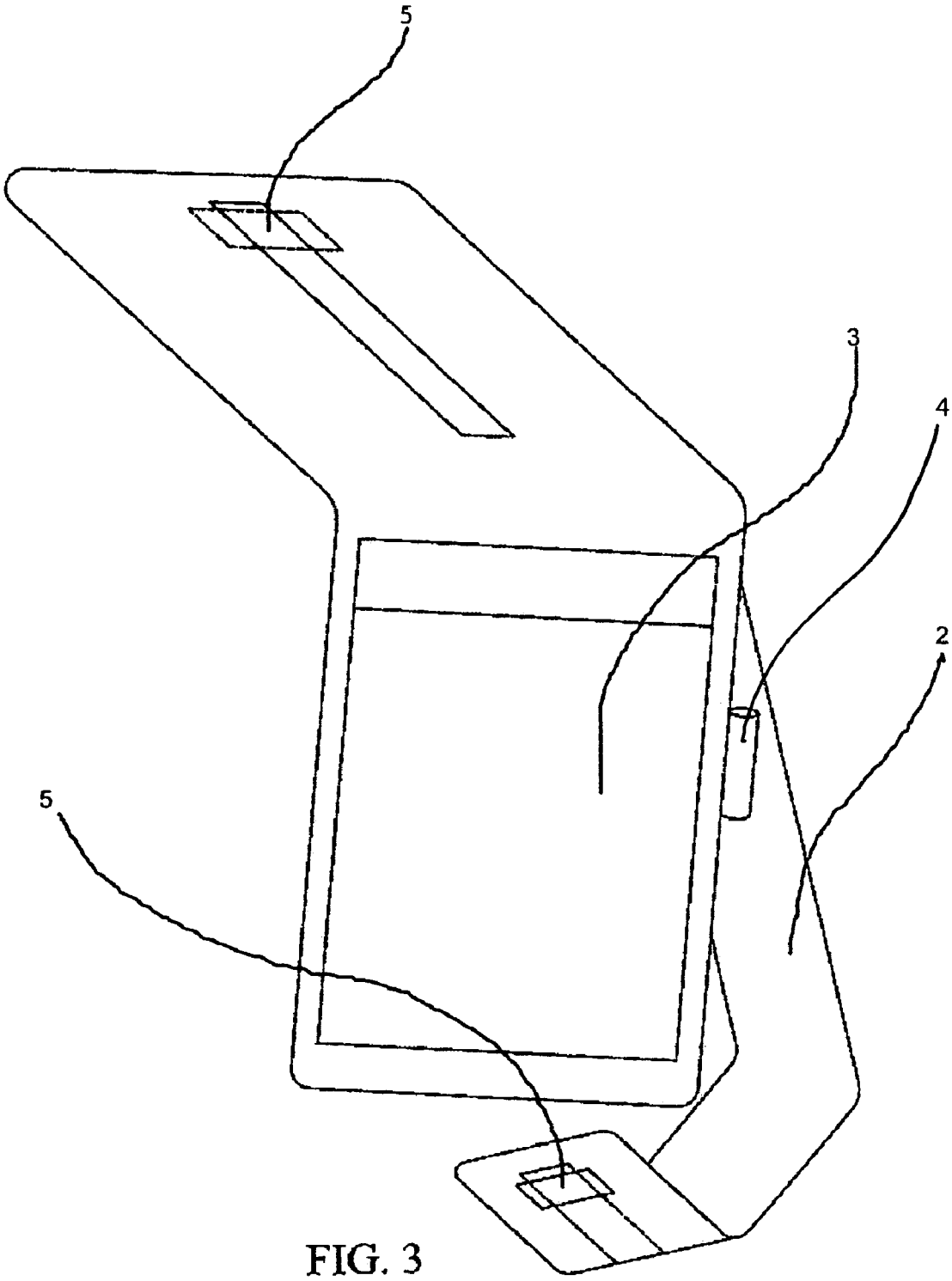
FIG. 3 is an elevational open inside view of the present note-pad holder with incorporated page mark.
Figure 4:
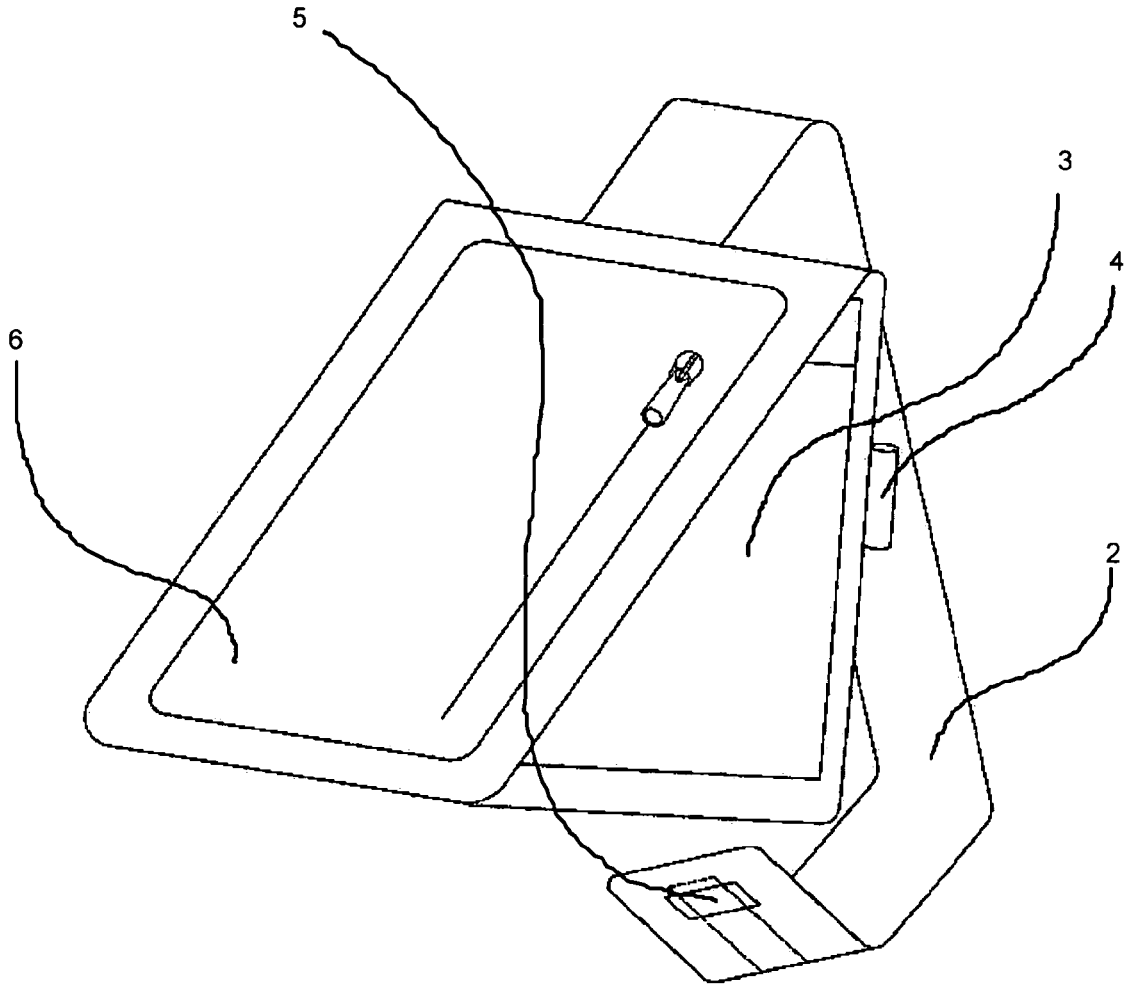
FIG. 4 is an elevational closed front view of the present note-pad holder with incorporated page mark.

A note pad holder with incorporated page marker is indicated generally and includes a structural protective cover and back support 3 having an attached adjustable page separator or marker 2 for attaching to any book 1 which is adjusted by utilization of Velcro attaching devices 5. Permanently affixed to the structural support 3 is a writing device holder 4. An accessories pocket 6 is located on the exterior of the structural support 3.

With continuing attention to the drawing, wherein applied reference numerals indicate parts similarly hereinafter identified, the reference numeral 1 indicates the book or hardback to attach the device. Numerals 2-6 are disposed as elements of the current device.

While I have shown but a few embodiments of the invention, it will be apparent to those skilled in the art that the invention may be embodied still otherwise without departing from the spirit and scope of the invention.

I claim:

1. A combination note-pad holder and page-marking device wherein the device is adapted to be attached to a book comprising:

a lid with an interior and exterior surface, a base with an interior and exterior surface, wherein the lid and base are substantially equal in size, a hinge coupling the lid and base together such that the lid and the base can be made to overlap and the interior surface of the lid faces the interior surface of the base forming a compartment therebetween for a storing a note-pad, a first hook and loop fastening section located on the interior surface of the lid;

a page-marking strap having a first end attached to the device adjacent the hinge and a second opposite end having a second hook and loop fastening section thereon whereby when the device is attached to the book, the strap is adapted to extend from the hinge, over a top edge of a cover of the book, between selected pages of the book and over a bottom edge of the cover of the book such that the second hook and loop fastening section connects with the first hook and loop fastening section and the base is positioned adjacent the cover of the book;

an accessory pocket on an exterior surface of the lid;

an instrument chamber permanently attached to a side of the base adapted to store a writing instrument.

* * * * *